US006367553B1

(12) United States Patent
Boyd

(10) Patent No.: US 6,367,553 B1
(45) Date of Patent: Apr. 9, 2002

(54) METHOD AND APPARATUS FOR CONTROLLING WELL PRESSURE WHILE UNDERGOING WIRELINE OPERATIONS ON SUBSEA BLOWOUT PREVENTERS

(76) Inventor: Anthony R. Boyd, 2204 Turnberry Dr., Loreauville, LA (US) 70552

( * ) Notice: Subject to any disclaimer, the term of this patent is extended or adjusted under 35 U.S.C. 154(b) by 0 days.

(21) Appl. No.: 09/571,787

(22) Filed: May 16, 2000

(51) Int. Cl.[7] ..... E21B 33/035

(52) U.S. Cl. ..... 166/360; 166/350; 166/367; 166/385; 166/368

(58) Field of Search ..... 166/360, 367, 166/368, 350, 385; 405/224.2

(56) References Cited

U.S. PATENT DOCUMENTS 3,656,549 A * 4/1972 Holbert, Jr. et al. ..... 166/356
4,313,694 A * 2/1982 Cox ..... 405/168

* cited by examiner

*Primary Examiner*—David Bagnell
*Assistant Examiner*—Zakiya Walker
(74) *Attorney, Agent, or Firm*—Garvey, Smith, Nehrbass & Doody, LLC

(57) ABSTRACT

The disclosure defined by this invention is a method and assembly for conducting wireline operations in a deep, subsea location, which includes providing a rig on the surface of a body of water, having a riser extending from the rig floor to the floor of the deep body of water; a hydril positioned on the end of the riser on the sea floor; a plurality of blowout preventers positioned below the riser to prevent a blowout into the riser; a wireline subsea blowout preventer control head assembly lowered into the riser to the level above the hydril; pressuring off the assembly by the riser and blowout preventers; lowering a wireline down the riser into the assembly, so that the tool may be lowered beyond the blowout preventers to conduct wireline operations; and pressuring off the side entry apparatus, so that should a blowout occur during wireline operations, any pressure would be prevented from entering the riser, but would be contained by the side entry assembly.

7 Claims, 6 Drawing Sheets

METHOD AND APPARATUS FOR CONTROLLING WELL PRESSURE WHILE UNDERGOING WIRELINE OPERATIONS ON SUBSEA BLOWOUT PREVENTERS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus and method of the present invention relates to wireline operations in the recovery of oil and gas. More particularly, the present invention relates to a method and apparatus for controlling well pressure while undergoing wireline operations on subsea blowout preventers on the subsea floor.

2. General Background of the Invention

In conducting wireline operations, many types of tools are positioned on the lower end of a wireline, which is a steel cable or the like, lowered into the well bore in order to undertake certain tests downhole. Because in the past there has been difficulties in undertaking wireline work with the potential hazard of blowouts in the well, there has been developed and patented by Harper Boyd, a side entry sub assembly which is patented under U.S. Pat. No. 4,681,162 and reissued under U.S. RE 33,150. This patented device, which is placed below the top drive on the rig floor, includes a side entry portion which enables the wireline to extend through the side entry passage and into the main passage and downward into the drill string. Although the use of the side entry sub is common for drilling, the system has never been applied safely on subsea blowout preventers which are located in deep water, since it controlling the well pressure at deep depths is very difficult. In deep waters of the Gulf of Mexico, there would be provided a floating subsea riser which would extend from the rig floor, on the Gulf surface, to the blowout preventers on the floor of the Gulf, sometimes some 4,000 to 7,000 feet in distance. It would be quite impractical to run a high-pressure line from the rig floor to the BOP stack on the Gulf floor to tie into the hydril so that one could pressure test the wireline. The BOP's need to be pressure tested, but the riser cannot take high pressure tests above the blowout preventers, or it would rupture and expel hydrocarbons into the Gulf waters. So, there is a need to be able to conduct subsea wireline operations in deep waters under pressure so that in the event a well would "come in" during the operations, the blowout would not reach the riser to the rig floor to avoid rupture of the floating subsea riser and a major catastrophe.

BRIEF SUMMARY OF THE INVENTION

The apparatus and method of the present invention solves the problems in a simple and straightforward manner. What is provided is a method for conducting wireline operations in a deep, subsea location, which includes providing a rig on the surface of a body of water, having a riser extending from the rig floor to the floor of the deep body of water; a hydril positioned on the end of the riser on the sea floor; a plurality of blowout preventers positioned below the riser to prevent a blowout into the riser; a wireline subsea blowout preventer control head assembly (the assembly) lowered into the riser to the level into the hydril; pressuring off the assembly by the riser and blowout preventers; lowering a wireline down the riser into the assembly so that the tool may be lowered beyond the blowout preventers to conduct wireline operations; providing a means to pressure off the assembly so that should a blowout occur during wireline operations, any pressure would be prevented from entering the riser, but would be contained by the assembly.

Therefore, it is a principal object of the present invention to provide a system for conducting wireline operations in a subsea conditions at the floor of the seabed, so as to prevent any undue pressure from rupturing the riser between the rig floor and the subsea floor.

It is a further object of the present invention to provide a method of conducting wireline operations deep within a subsea conditions, without subjecting the riser between the rig floor and the seabed to blowout pressures;

It is a further object of the present invention to provide a wireline subsea blowout preventer control head assembly system used in subsea conditions for allowing wireline work to be conducted at the sea floor, under pressure, so as to allow pressure testing of components of the system without fear of compromising the integrity of the riser which may cause a catastrophic oil or gas spill into the body of water.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
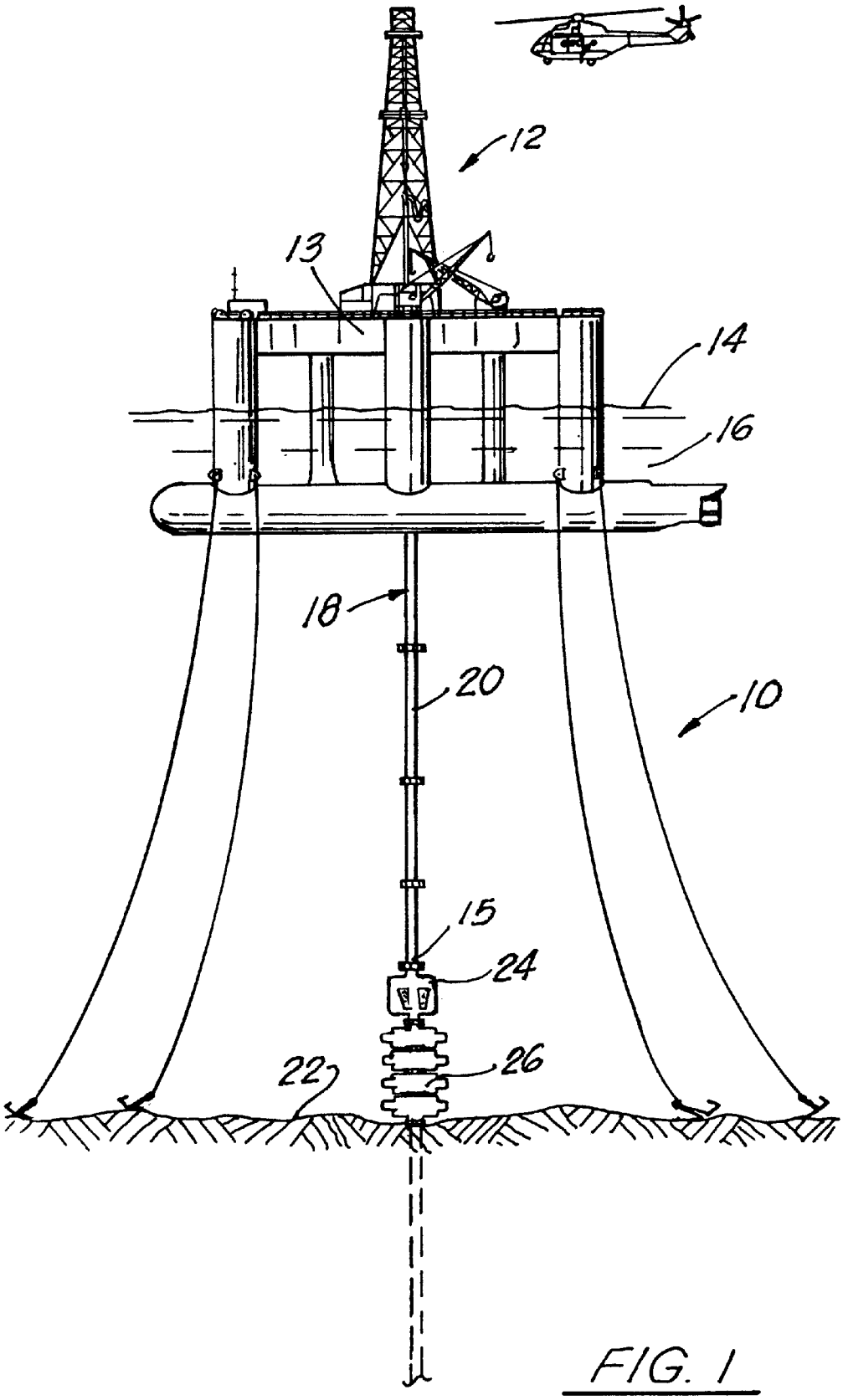
FIG. 1 illustrates an overall view of a typical rig and subsea assemblies positioned within a deep water setting during drilling offshore.
Figure 2:
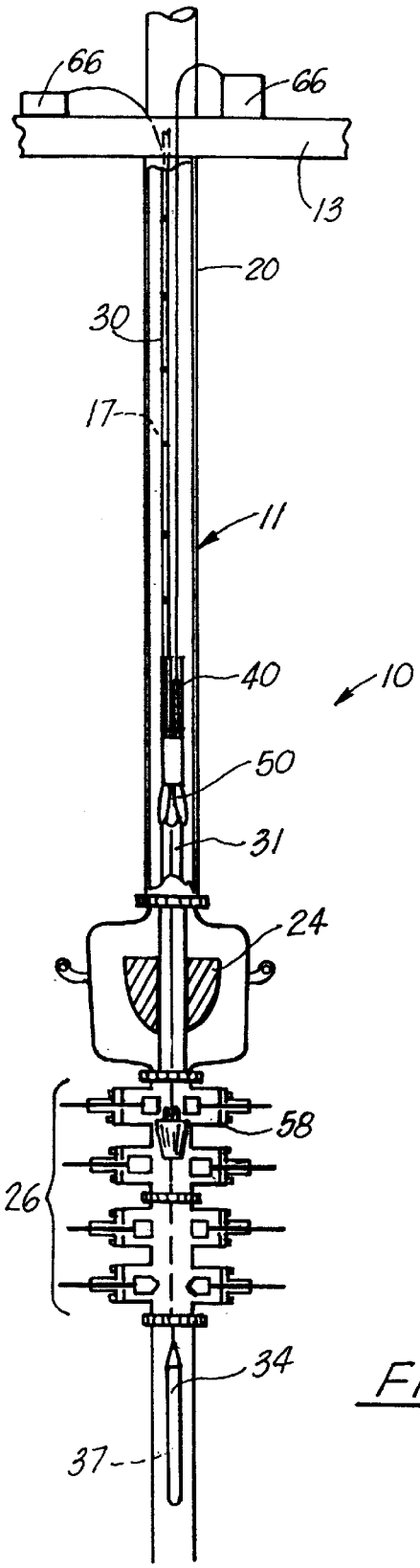
FIG. 2 illustrates an overall view of a typical rig and subsea assemblies positioned within a deep water setting during drilling offshore utilizing the system of the present invention.
Figure 3:
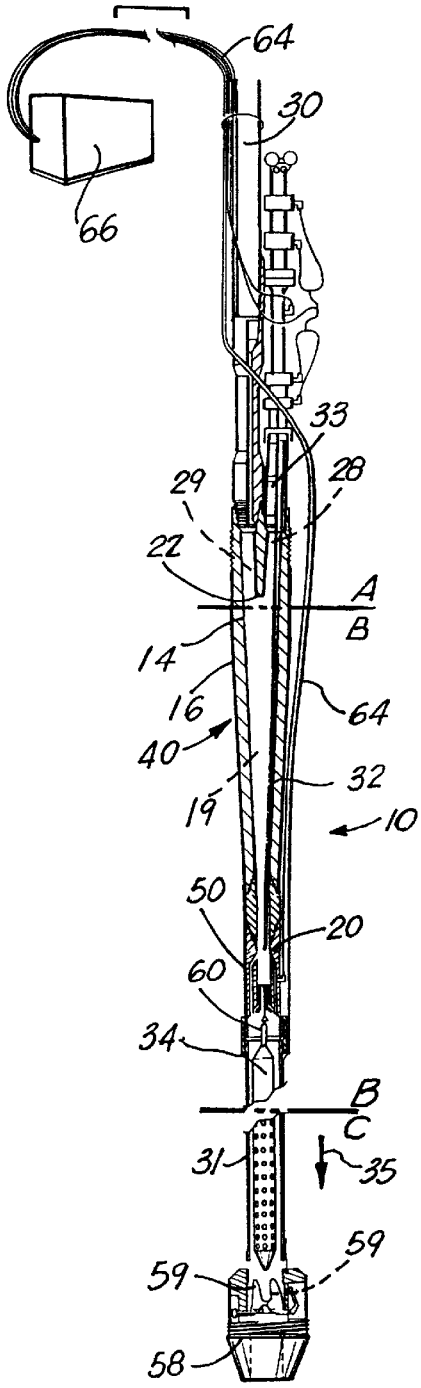
FIG. 3 illustrates a detailed view of the wireline subsea blowout preventer control head assembly used in the present invention for conducting subsea wireline work under pressure.
Figure 6:
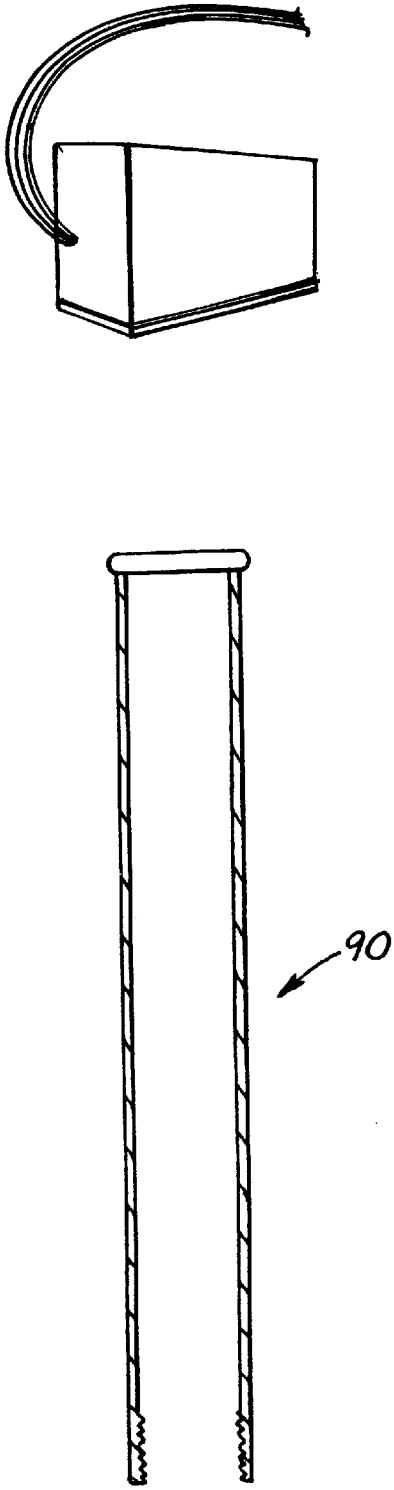
FIG. 6 illustrates a view of a protective sleeve used in the present invention.
Figure 4A:
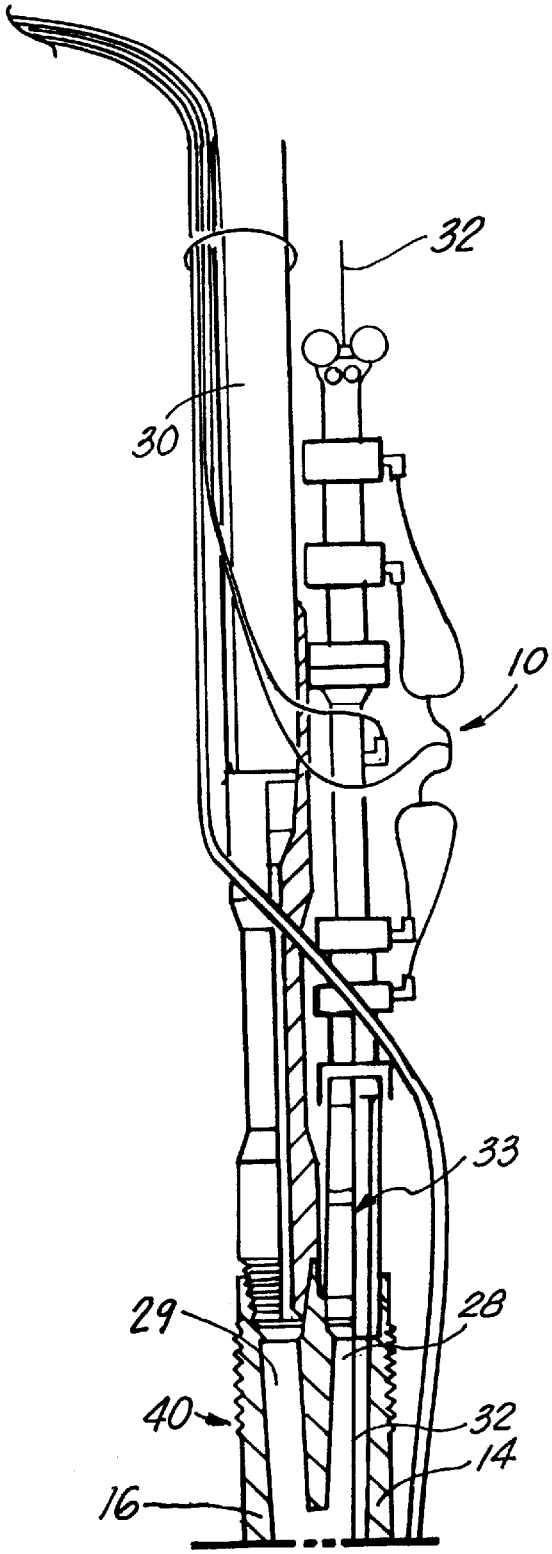
FIGS. 4A through 4C illustrate isolated detailed views of the wireline subsea blowout preventer control head assembly and the other assemblies used in the present invention for conducting subsea wireline work under pressure.
Figures 4B, 4C:
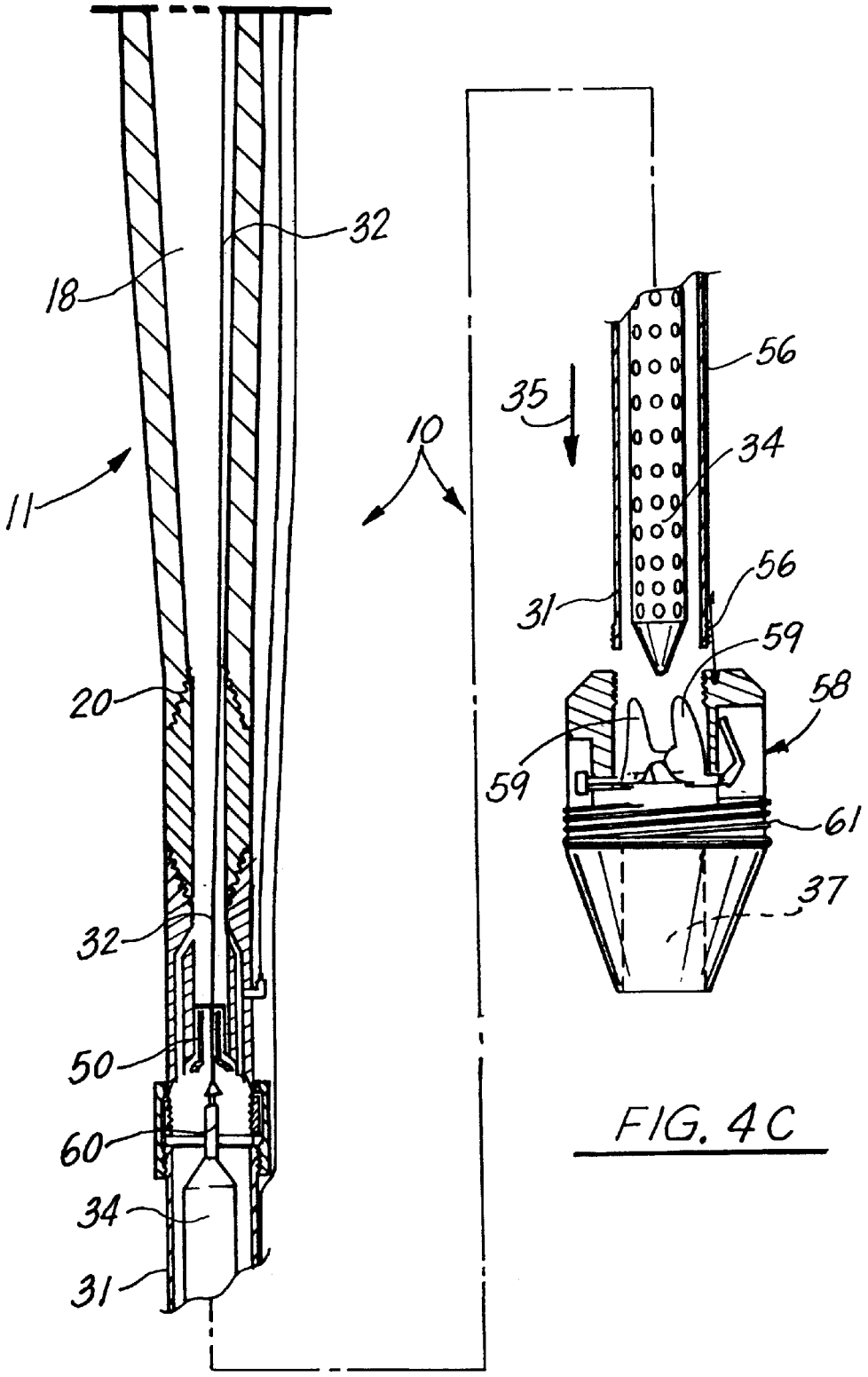

FIGS. 1–7 illustrate the preferred embodiment of the system of the wireline subsea blowout preventer control head assembly (assembly 10) of the present invention illustrated by the numeral 10, as seen in FIGS. 2, 3 and 4. Prior to discussing assembly 10 in detail, reference is made to FIG. 1, where there is illustrated in cross section a typical rig 12 positioned on the surface 14 of a body of water 16, such as the Gulf of Mexico. The rig would include an extended riser 18, comprising a plurality of tubular elements 20, threaded end to end to define the entire riser 18 extending from the rig floor 13, to the seabed 22. For purposes of this discussion the rig 12 may be in water as deep as 10,000 feet, and the riser 18 would be therefore 10,000 feet in overall length. Such a riser is normally some 20 inches in diameter, but can only withstand internal pressures of around 2000 lbs. before the riser would rupture. This, of course, must be avoided since such a rupture may allow fluid hydrocarbons to spill out into the body of water, a catastrophic event.

As part of the overall assembly 10, the lower end 15 of the riser 18 would terminate and attach to a hydril 24, which is known in the art, and would not have to be discussed in detail. The hydril 24 is positioned above a series of blowout preventers 26 (BOPs 26), together which would prevent any blowout or excess pressure from downhole to be prevented by closing off the passage of the fluids up the riser 18.

Reference is now made to FIG. 2 which illustrates the assembly as discussed in FIG. 1, together with the components to provide the overall assembly of the present invention. As seen in FIG. 2, the riser 18 has contained therein a length of drill pipe 30 which has been lower down the bore 17 of the riser 18 to a point above the hydril 24. The drill string 30 would include the assembly 10 at its lower end. The assembly 10 would be seen in more detail in FIGS. 3 and 4A–4C, in general, would include a principal tool body 14 with a circular outer wall 16, the tool body 14 having a principal passage portion 19 extending from the lower end 20 of the tool body to an upper point 22 of the tool body as illustrated in FIG. 3. There is further illustrated the passage 29 extending into a first principal passage 19 which would be threaded onto the drill string 30, as seen in the figures. There is formed a second passage 28 which has a packoff assembly portion 33 secured there through wherein a wireline (line 32) extends there through downward into the principal passage 19 of the tool and down into the annulus of the lower drill pipe 31. As seen, wireline 32 has a tool 34 at its and in moving in the direction of arrow 35 moving down the borehole 37.

It is important to note with the use of the assembly 10 as seen in FIGS. 3 and 4A–4C, there is provided a head catcher 50 secured to the lower end 20 of the assembly 10, the head catcher of the type commonly used in grease work on a rig, but not heretofore used in connection with high pressure wireline operations conducted at subsea depths. The tool head catcher 50 secured to the lower end of the assembly 10 is connected at its lower end to the length of pipe 31, with the lower end of the pipe 31 connected to a tool trap 58, again known in the art in oilrig grease work, but not with sub sea high pressure wireline operations. As seen further in FIG. 2, the wireline tool 34 is extending through the opening in the tool trap 58, and is being moved downhole having been directed through the assembly 10 and through the open BOP's below the tool trap 58 for moving downhole to conduct wireline operations. With the pipe 31 secured within hydril 24, there is no possibility of the assembly 10 rotating or wrapping the stainless steel or hydraulic lines 64 that extend up the drill string 30 from the source 66, as seen in FIG. 3.

For clarification, the tool trap 58 is well known in the art, in that it is a spring-loaded assembly which remains open as long as a wireline tool 34 is extending through it. When the tool 34 moves above the trap 58, a spring-loaded trap door 59 closes to seal off the opening, so that the tool 34 may not inadvertently be dropped below the trap 58. If, however, the trap 58 fails, then the tool catcher 50, described above, would catch the tool 34 in the rope socket 60, secured to the top of the tool 34.

During operation, the method would include lowering a drill string 30 with the wireline apparatus 40 down the annulus of the riser 18. The wireline apparatus 40 would include a head catcher 50 secured to its lower end, and a section of pipe 31 extending down from the catcher. The pipe 31 would have a tool trap 58 secured to its lower end. When the pipe 31 has been lowered into the opening of the hydril 24 and BOPs 26, these are closed around the 40 ft. pipe 31, between the head catcher 50 and the tool trap 58. The BOPs 26 would also be secured around the pipe 31, therefore eliminating any chance of pressure moving up the annulus between the riser 18 and the drill string 30. The wireline tool 34 would be lowered through the riser 31, where it would be lowered through the opening in the tool trap 58 and down the borehole. Wireline work can then safely be done under pressure. Should a blowout occur downhole, the BOPs and hydril would prevent high pressure from entering between the tool and the casing, and the wireline apparatus 40 would not allow the pressure to move up the annulus of the riser 20, but would be captured by the packoff assembly portion 33.

Figure 5:
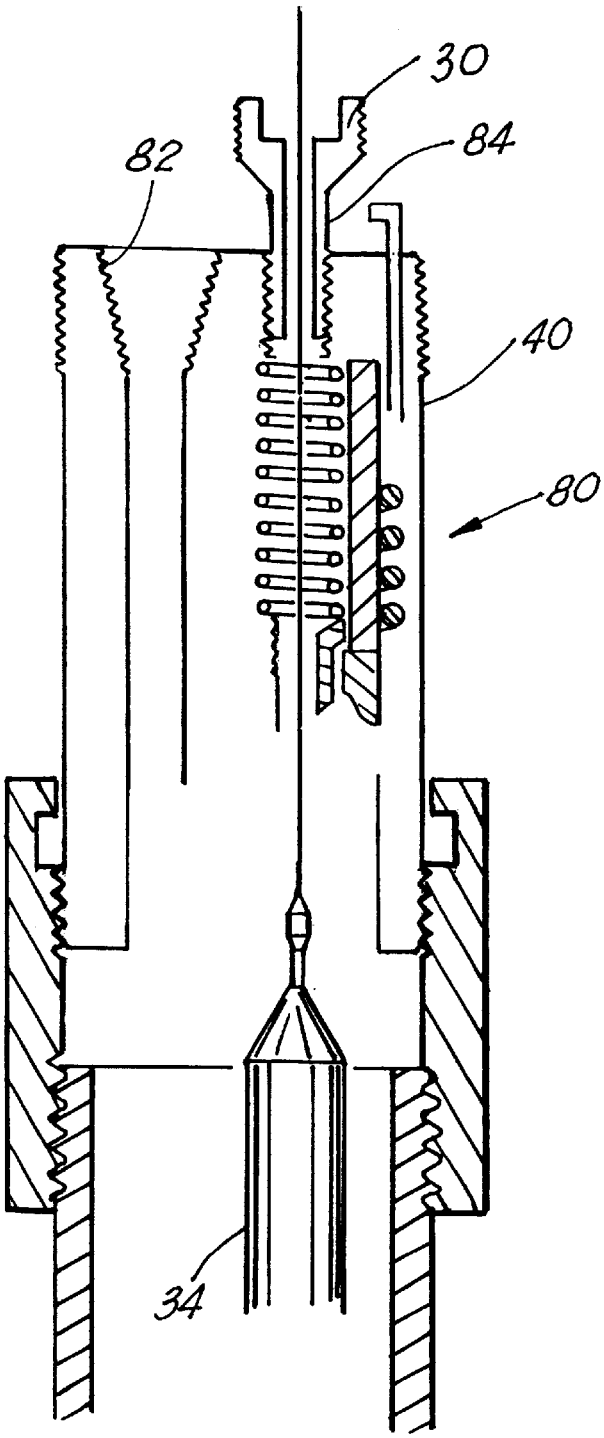
FIG. 5 illustrates a view of a wireline subsea blowout preventer control head assembly for use in the method of the present invention.

FIG. 5 illustrates a modified tool catcher 80. As illustrated, there would be a primary threaded connection 82 for connecting onto a section of drill pipe 30 above the tool 34. The packoff assembly portion 33 of the assembly 10 would connect at point 84, which in effect creates a much shorter assembly 10 and head catcher connection so as to allow the use of an external protective sleeve 90 to be slid on top of the assemblies, of the type illustrated in FIG. 6. Therefore, the hydraulic lines 64 would be within the protective sleeve 90, including other components of the downhole assembly 10 to avoid being exposed to the outside.

Figure 7:
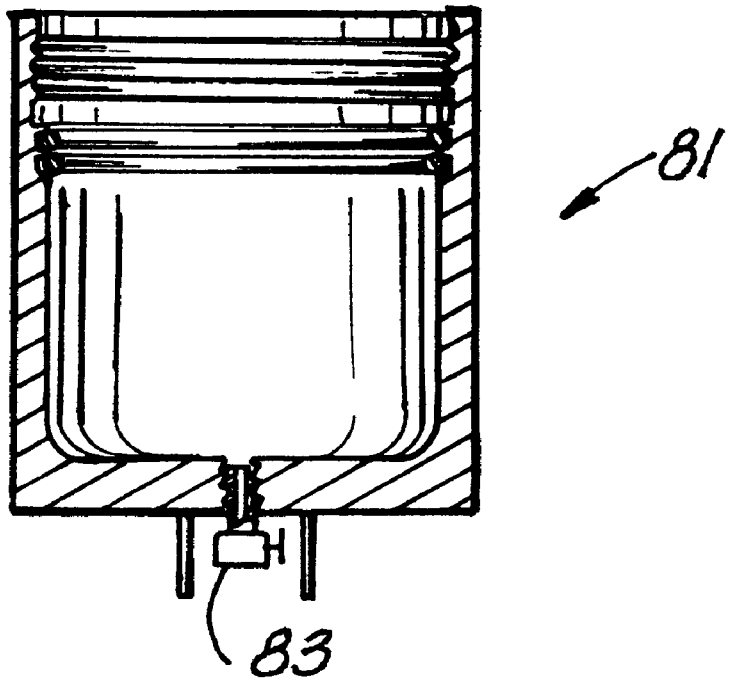
FIG. 7 illustrates a view of a cap member positionable on the end of the tool trap used in the present invention.

FIG. 7 illustrates a cap member 81 which would be threadably engaged on the lower end 61 of tool trap 58 when the integrity of the system would be tested under pressure, with cap 81 including a valving member 83 to release pressure during or after the test.

The foregoing embodiments are presented by way of example only; the scope of the present invention is to be limited only by the following claims.

What is claimed is:

1. A method of conducting wireline operations in deep subsea environment, comprising the following steps:

a. providing a rig having a riser extending between the rig floor and the floor of the body of water;

b. providing at least a hydril and BOP stack secured to the lower end of the riser;

c. lowering a drill string down the annulus of the riser;

d. positioning a wireline subsea blowout preventer control head assembly at the end of the drill string;

e. securing a length of pipe to the lower end of a wireline entry apparatus;

f. sealingly engaging the length of pipe by the hydril and BOP stack;

g. lowering a tool on the end of a wireline through the wireline entry apparatus so as to conduct wireline operations below the hydril, while being able to maintain pressure on the drill string.

2. The method of claim 1, wherein the wireline entry apparatus comprises:

a. a tool body having a first lower end and a second upper end;

b. a principal bore through the tool body from the upper to the lower end;

c. a portion of the tool body having a second bore intersecting into the principal bore for allowing a wireline to be inserted through the second bore and extend from the lower end of the tool body for conducting wireline work under pressure.

3. An assembly for conducting wireline operations in deep subsea environment, comprising a wireline subsea blowout preventer control head assembly lowered down an annulus of a riser to substantially the level of the seabed for conducting wireline operations under pressure; the assembly utilized in conjunction with a hydril and BOP stack to prevent pressure from downhole to enter and adversely effect the integrity of the riser.

4. A method of conducting wireline operations in deep subsea environment, comprising the following steps:

a. providing a rig having a riser extending between the rig floor and the floor of the body of water;

b. providing at least a hydril and BOP stack secured to the lower end of the riser;

c. lowering a drill string down the annulus of the riser;

d. positioning a wireline entry apparatus at the end of the drill string;

e. securing a length of pipe to the lower end of the wireline entry apparatus;

f. sealingly engaging the length of pipe by the hydril and BOP stack;

g. lowering a tool on the end of a wireline through the wireline entry apparatus so as to conduct wireline operations below the hydril, while being able to maintain pressure on the drill string; and h. providing a means for securing the tool should the wireline above the tool rupture while the tool is downhole.

5. The method of claim 4, wherein the wireline entry apparatus comprises:

a. a tool body having a first lower end and a second upper end;

b. a principal bore through the tool body from the upper to the lower end;

c. a portion of the tool body having a second bore intersecting into the principal bore for allowing a wireline to be inserted through the second bore and extend from the lower end of the tool body for conducting wireline work under pressure.

6. An assembly for conducting wireline operations in deep subsea environment, comprising:

a. a wireline subsea blowout preventer control head assembly positioned at the end of a drill string, and lowered down an annulus of a riser to substantially the level of the seabed, so that the assembly may conduct wireline operations under pressure; and b. the wireline subsea blowout preventer control head assembly operating within the riser with a hydril and BOP stack to prevent pressure from downhole to enter and adversely effect the integrity of the riser while the wireline operations are ongoing.

7. The assembly in claim 6, wherein there may be further provided a modified entry sub so that a protective sleeve may be positioned over the sub to avoid portions of the sub making contact with objects down the hole.

* * * * *